US006579196B1

(12) United States Patent
Yoon

(10) Patent No.: US 6,579,196 B1
(45) Date of Patent: Jun. 17, 2003

(54) MODULAR ALL SPORTS NET ASSEMBLY

(76) Inventor: Young W. Yoon, 127 Michael Mannor, Glenview, IL (US) 60025

( * ) Notice: Subject to any disclaimer, the term of this patent is extended or adjusted under 35 U.S.C. 154(b) by 0 days.

(21) Appl. No.: 09/356,290

(22) Filed: Jul. 16, 1999

(51) Int. Cl.[7] ..... A63B 69/00
(52) U.S. Cl. ..... 473/421; 473/478; 473/422
(58) Field of Search ..... 473/197, 159, 473/492, 426, 421, 478

(56) References Cited

U.S. PATENT DOCUMENTS

| | | | | |
|---|---|---|---|---|
| 2,922,653 A | * | 1/1960 | O'Brien | 267/256 |
| 3,001,795 A | | 9/1961 | Johnson, Jr. | |
| 3,195,898 A | | 7/1965 | Respini | |
| 3,424,178 A | * | 1/1969 | Yataki | 135/157 |
| 3,675,667 A | | 7/1972 | Miller | |
| 3,698,712 A | | 10/1972 | Pero | |
| 3,960,161 A | | 6/1976 | Norman | |
| 3,990,463 A | | 11/1976 | Norman | |
| 4,063,739 A | | 12/1977 | La Rose | |
| 4,083,561 A | * | 4/1978 | Daffer | 473/432 |
| 4,523,760 A | | 6/1985 | Bednarczuk | |
| 4,556,219 A | * | 12/1985 | Tillery | 473/197 |
| 4,702,478 A | * | 10/1987 | Kruse | 273/127 B |
| 4,825,892 A | | 5/1989 | Norman | |
| 4,858,634 A | | 8/1989 | McLeese | |
| 5,088,740 A | | 2/1992 | Peterson | |
| 5,163,461 A | | 11/1992 | Ivanovich et al. | |
| 5,249,592 A | | 10/1993 | Springer et al. | |
| 5,337,772 A | | 8/1994 | Habchi | |
| 5,407,178 A | * | 4/1995 | Long | 256/45 |
| 5,421,586 A | | 6/1995 | Amram et al. | |
| 5,421,666 A | * | 6/1995 | Spears | 403/176 |
| 5,427,381 A | | 6/1995 | Macaluso et al. | |
| 5,439,017 A | | 8/1995 | Brown | |
| 5,569,094 A | | 10/1996 | Macaluso | |
| RE35,571 E | | 7/1997 | McLeese | |
| 5,645,096 A | | 7/1997 | Hazinski et al. | |
| 5,676,168 A | | 10/1997 | Price | |
| 5,730,442 A | * | 3/1998 | Anderson | 273/400 |
| 5,816,278 A | | 10/1998 | Kim | |
| 5,842,940 A | | 12/1998 | Macaluso | |
| 5,976,023 A | | 11/1999 | Cho | |
| 5,989,130 A | | 11/1999 | Macaluso | |
| 6,135,894 A | | 10/2000 | Cho | |

FOREIGN PATENT DOCUMENTS

| | | |
|---|---|---|
| FR | 2485379 | 12/1981 |
| GB | 21909 | 10/1906 |

OTHER PUBLICATIONS

@gricultureonline pp. 1–3, http://www.agriculture.com/sfonline/archive/sf/aatf/march96.html., Mar. 1, 1996.*
The Ohio Nut and Bolt Company pp. 1–9, http://www.on–b.com/product/weldata/wldguide.htm, May 2, 2002.*
Kwikgoal; 1999 Soccer Equipment (1998); 140 Pacific Drive Quakertowne, PA 18951.
"The Golfsmith Store," Holiday 1997.
"Hammacher Schlemmer," Summer 1998.
"High Street Emporium," Summer 1998.
"Golfsmith," 1998.
"Brookstone Gift Collection," Jun. 1999.
"The Goldsmith Store," Jul. 1999.
"Golf Day," Catalog 129C3.
"Excalibur SunScreen," Excalibur Electronics, Inc.

* cited by examiner

*Primary Examiner*—Paul T. Sewell
*Assistant Examiner*—M. Chambers
(74) *Attorney, Agent, or Firm*—Price Heneveld Cooper DeWitt & Litton

(57) ABSTRACT

An all sports net assembly is disclosed for providing an enclosure for receiving and retaining a sports item such as a ball or the like. The net assembly may be readily assembled for deployment on any relatively flat ground surface and disassembled for storage. The assembly includes a tubular frame structure formed into the shape of a prism. A plurality of intermediate pole segments interconnect a plurality of corner units. Each of the corner units comprises projecting pole receiving portions extending along at least three independent axis, where each pole receiving portion receives an end of said intermediate pole segments to define at least four planes. A plurality of netting panels are removably attached to the tubular frame structure so as to enclose the frame assembly except for one plane of the tubular frame structure.

45 Claims, 12 Drawing Sheets

FIG. 7
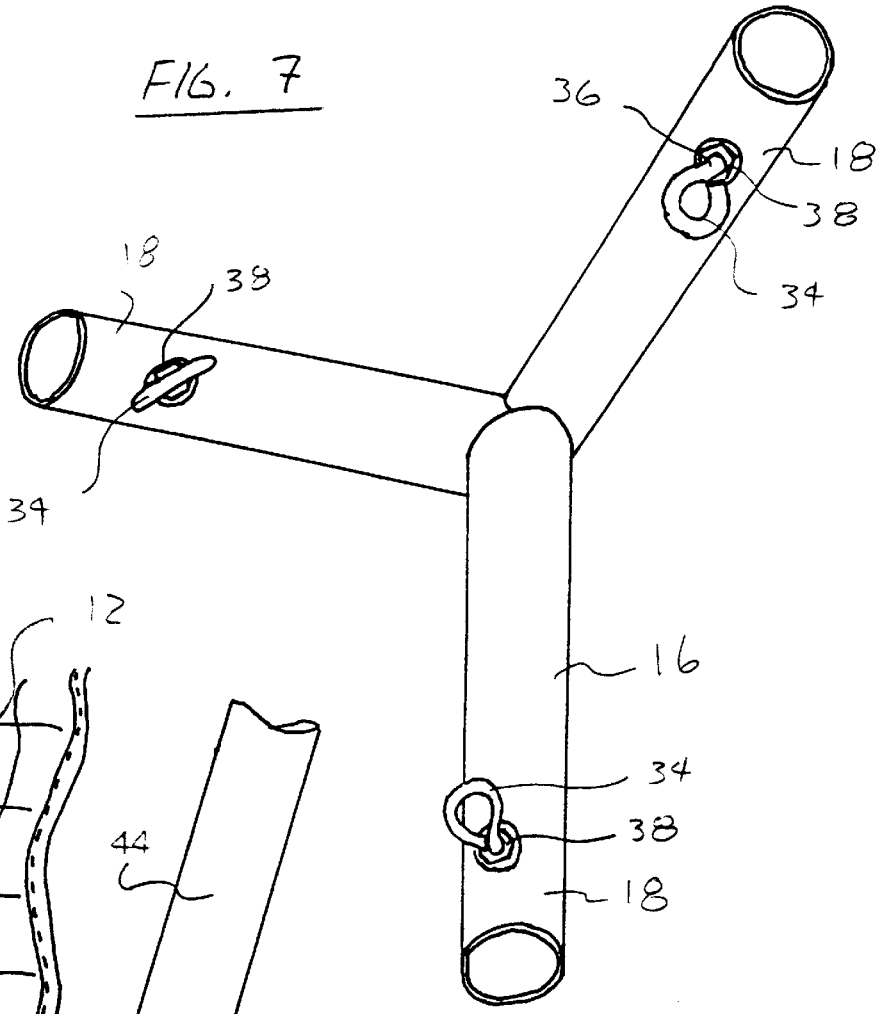
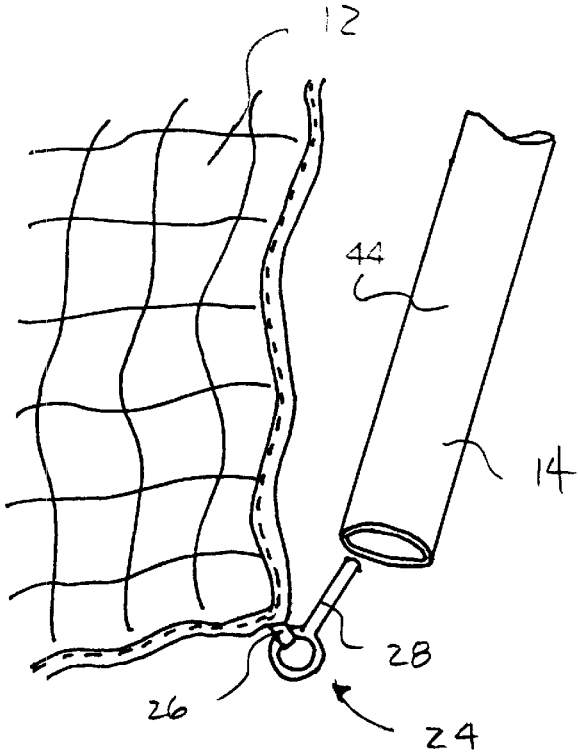
FIG. 6

FIG. 13
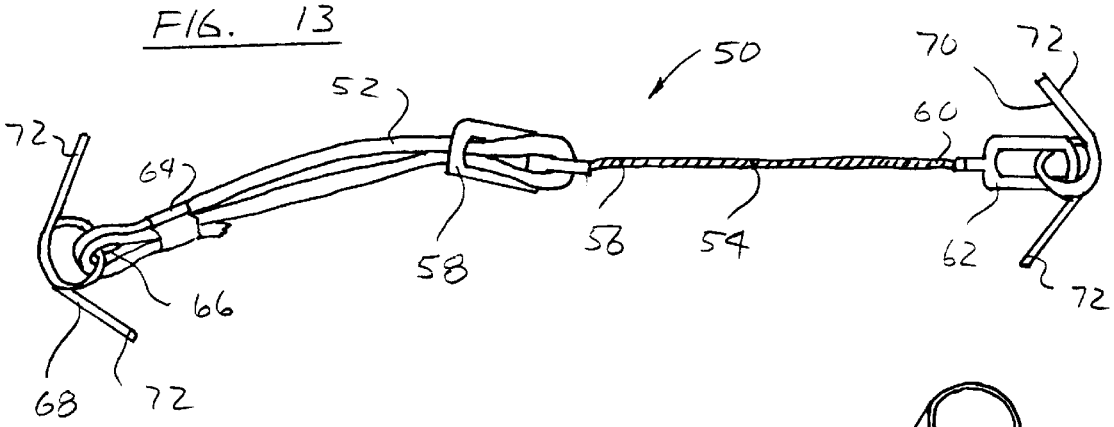
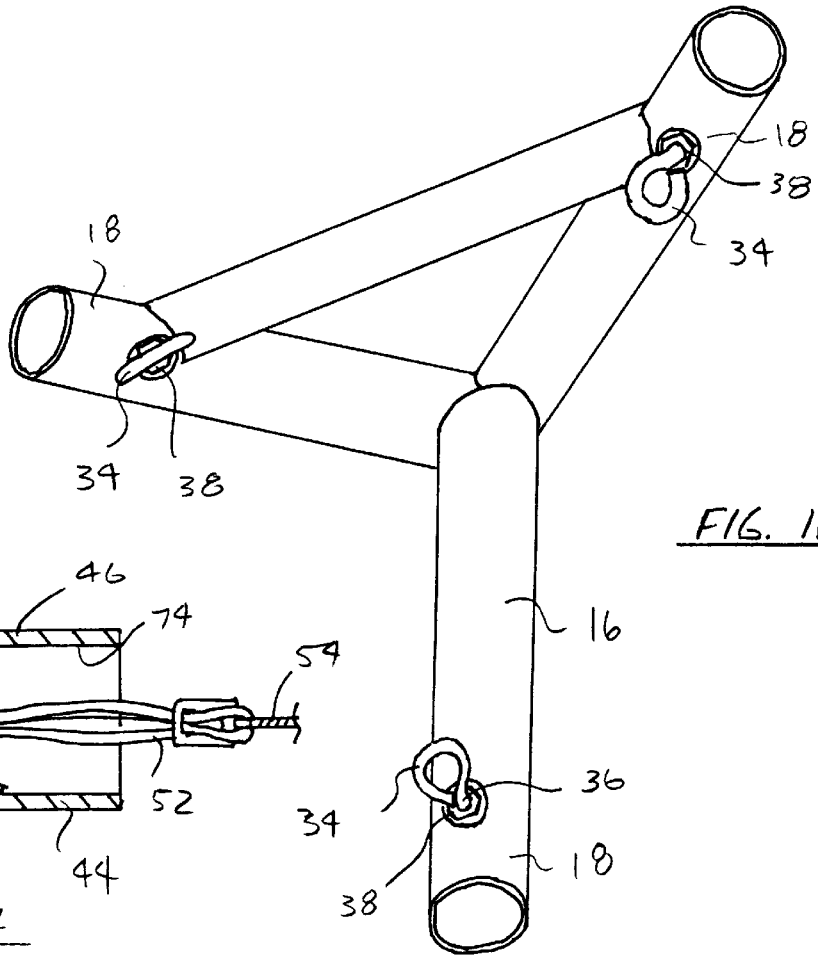
FIG. 10
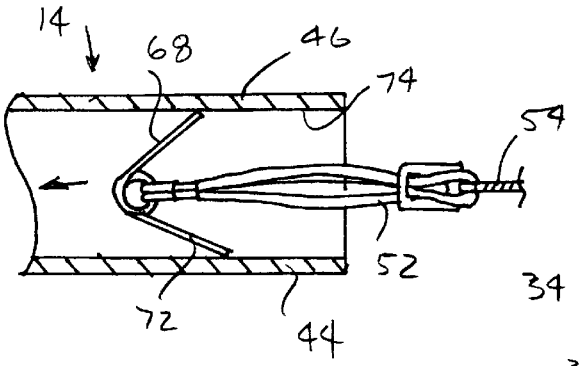
FIG. 14

MODULAR ALL SPORTS NET ASSEMBLY

FIELD OF THE INVENTION

The present invention generally relates to an all sports net. In particular, the present invention relates to a modular net and frame assembly adapted to a variety of sports, the net forming an enclosure for receiving and retaining a sports item such as a ball or the like, and the enclosure being formed into the shape of a prism. A plurality of netting panels are removably attached to a tubular frame structure to enclose the frame assembly except for at least one open side plane.

BACKGROUND OF THE INVENTION

Nets are commonly used for a wide variety of sporting activities played on an level, open field. A representative, but certainly not exhaustive, list of such sports includes soccer, field hockey, batting and pitching practice for baseball, throwing and kicking practice for football, golf driving practice and archery practice. Unfortunately, nets for each of these sports have not been seen as interchangeable and, indeed, have in the past taken on different sizes and shapes.

The primary users of such nets are institutional users, such as schools, churches and leagues. However, even though these institutional users typically look for ways to save funds, they have found it necessary in the past to purchase a specific net or nets for each sport. It would therefore be advantageous for such institutional users, as well as other users such as individuals, to be able to purchase one or just a few nets that can be adapted for use with every sport.

Unfortunately, such a universal sports net has not been readily available. Several net designs exist, including frame and net structures. These nets typically include a frame forming a periphery to which is attached a mesh or net material. Some frames comprise a set of interlocking right-angle poles that, when fully assembled, form a rectangular shape across which a screen or net is a positioned and into which a sport object can be thrown or kicked. Such frames, however, are typically dedicated to a single sport, usually fairly expensive and complex to assemble, particularly alone. Other frames comprise self-erecting flexible rings that can be folded upon themselves and which are attached about their periphery to a net or mesh. Although easier to deploy, such frames likewise are dedicated to a single sport use.

SUMMARY OF THE INVENTION

To overcome these and other disadvantages of the prior art, the present disclosure, briefly described, provides an improved all sports net assembly for forming an enclosure for receiving and retaining a sports item such as a ball or the like. The assembly may be readily assembled for deployment on any relatively flat ground surface and subsequently readily disassembled for storage The assembly includes a tubular frame structure formed into the shape of a prism, preferably a regular square prism. A plurality of intermediate pole segments interconnect a plurality of corner units. Each of the corner units comprise pole receiving portions extending along at least three independent axes, preferably in at least the vertical and two horizontal directions, where each pole receiving portion receives an end of an intermediate pole segment to define at least independent four flat intersecting and interconnected planes. A plurality of netting panels are removably attached to the tubular frame structure so as to enclose the tubular frame structure except for at least one side of the tubular frame structure.

The modular all sports net assembly of the present invention can be readily assembled and disassembled, while providing a net that is very effective for use in number of different sports, such as a goal net for soccer or field hockey or a backstop for batting or golf driving practice. The frame structure and net assembly can be readily adapted to form a regular square prism only or can be combined to form other prisms of varying shapes and sizes. In a particular embodiment of the invention, the netting is formed from individual, discrete panels that can be deployed upon the frame assembly to form a rectangle when joined with other tubular frame structures having an opening along the longer side of such a rectangle or as an enclosure with an opening on only one side to create an extended net or tunnel.

As will appear from the detailed description of the preferred embodiment to follow, the features of the all sports net render it suitable for a wide variety of conditions and uses. Particularly in the case of institutions such as schools and colleges, the flexibility and adaptability of the present invention to an almost infinite number of applications render a sports net virtually always readily available, and therefore offers an overall relatively inexpensive net compared to nets having a single dedicated sports application or use.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto.

In this respect, before explaining the preferred embodiment of the disclosure in detail, it is to be understood that the disclosure is not limited in its application to the details of the construction and the arrangements set forth in the following description or illustrated in the drawings. The modular all sports net of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

Therefore, it is the primary object of the present invention to provide a modular all sports net that is readily adapted to function advantageously with a number of different sports, such as soccer and baseball.

It is a further object of the present invention to provide a new modular all sports net that is formed from easily manipulated pole and corner sections that is easily assembled and disassembled.

It is another object of the present invention to provide a modular all sports net that forms an enclosure for receiving and retaining a sports item such as a ball or the like to restrict the travel of the ball so that the ball immediately drops to the ground upon impacting the net.

It is still yet an object of the present invention to provide a modular all sports net formed from interlocking pole and corner sections where the poles are further collapsible for easier storage.

It is yet an additional object of the present invention to provide a new modular all sports net that is relatively inexpensive, robust and durable.

These and other objects, along with the various features and structures that characterize the invention, are pointed out with particularity in the claims annexed to and forming a part of this disclosure. For a better understanding of the modular all sports net of the present disclosure, its advantages and the specific objects attained by its uses, reference should be had to the accompanying drawings and descriptive matter in which there are illustrated preferred embodiments of the invention.

While embodiments of the all sports net are herein illustrated and described, it is to be appreciated that various changes, rearrangements and modifications may be made therein, without departing from the scope of the invention as defined by the appended claims.

BRIEF DESCRIPTION OF THE FIGURES

The disclosure of the modular all sports net is explained with illustrative embodiments shown in the accompanying drawing, where:

FIG. 6 is a perspective view of the lower net panel and lower vertical pole connector;

FIG. 7 is a perspective view of a first preferred embodiment of one of the corner units of the tubular frame of the present invention having orthogonally projecting pole receiving portions extending in the vertical and two horizontal directions and locking turnbuckles;

FIG. 10 is a perspective view of a fourth preferred embodiment of one of the corner units of the frame assembly of the present invention having orthogonally projecting pole receiving portions extending in the vertical and two horizontal directions, a bracing bar and locking turnbuckles;

FIG. 13 is a plan view of the stretchable connecting cable for connecting one of the intermediate pole segments;

FIG. 14 is a cross-sectional view of one end portion of one of the intermediate pole segments for interconnecting the corner units;

DETAILED DESCRIPTION OF THE PREFERRED EMBODIMENT

Figure 1:
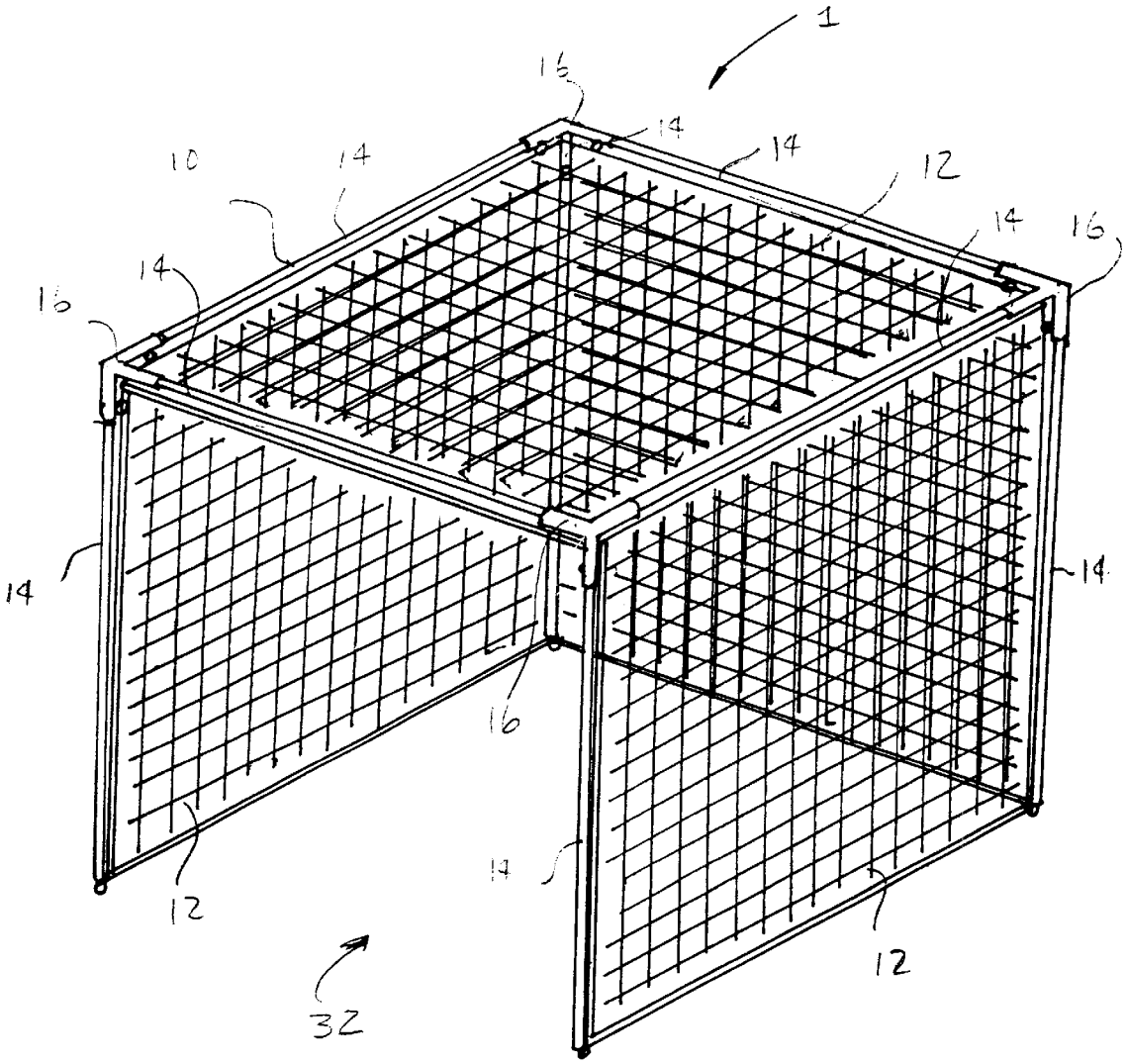
FIG. 1 is a perspective overall view of the preferred embodiment of the present invention.

The best mode for carrying out the invention is presented in terms of the preferred embodiment, wherein similar reference characters designate corresponding features throughout the several figures of the drawings.

Referring now to the drawings, particularly FIG. 1, there is shown in perspective view the modular all sports net assembly 1 of the present invention. The modular all sports net assembly 1 consists primarily of a tubular frame 10 and a plurality of netting panels 12. The tubular frame 10 of the present invention forms the shape of a regular prism, preferably as a unitary square prism or cube as seen in FIG. 1. In the preferred embodiment, as shown, the tubular frame 10 adopts the form of a regular prism, wherein prism as used herein is defined as a polyhedron having two polygon sides in parallel planes and two sides formed in the shape of parallelograms. The preferred prism includes four identical and interchangeable intermediate tubular pole segments 14, each having the same length, horizontally interconnecting four upper corner units 16. Each of the preferred corner units 16 have at least a trio of projecting pole receiving portions 18, preferably extending orthogonally in two horizontal and one vertical depending directions, as shown in FIGS. 7, 9, 10 and 17. Each pole receiving portion 18 of the preferred corner unit 16 is adapted to receive one end of one of the horizontal intermediate pole segments 14, with the horizontally projecting pole receiving portions 18 cooperating with the horizontal intermediate pole segments 14 to form a flat horizontal top plane. One of four additional and identical interchangeable intermediate tubular pole segments 14, also having the same length as the horizontal pole segments 14, are received within each of the vertically depending pole receiving portions 18 of the preferred corner unit 16 to form four flat vertical side planes and columns upon which the assembly 1 is supported.

Figure 2:
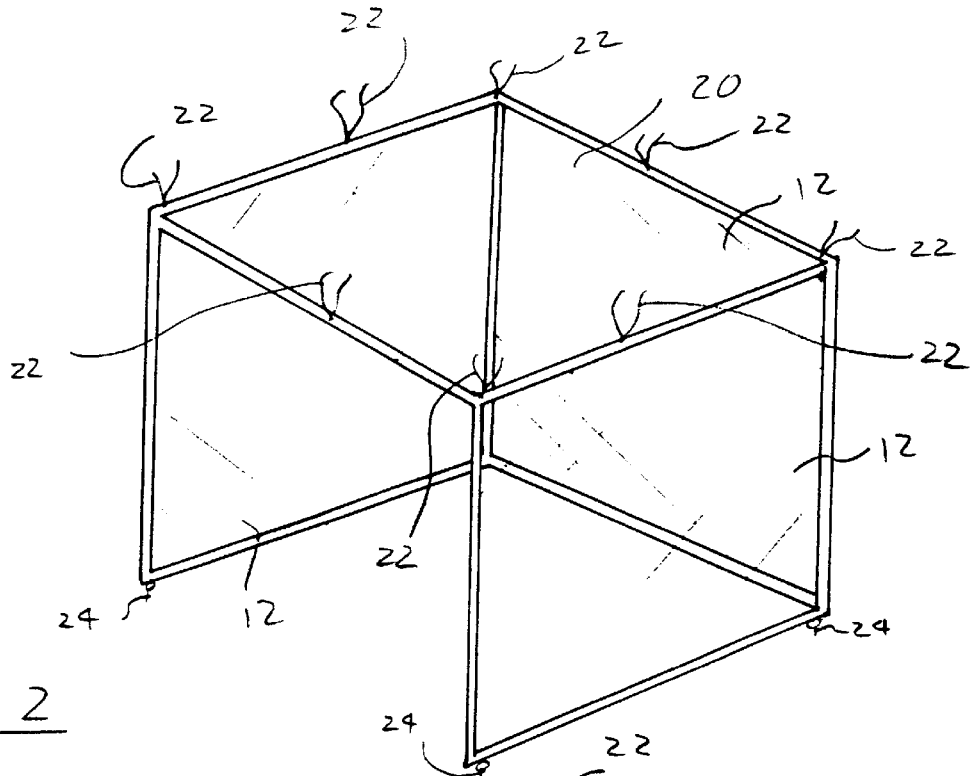
FIG. 2 is a perspective view of a first preferred embodiment of the netting panels of the present invention.
Figure 3:
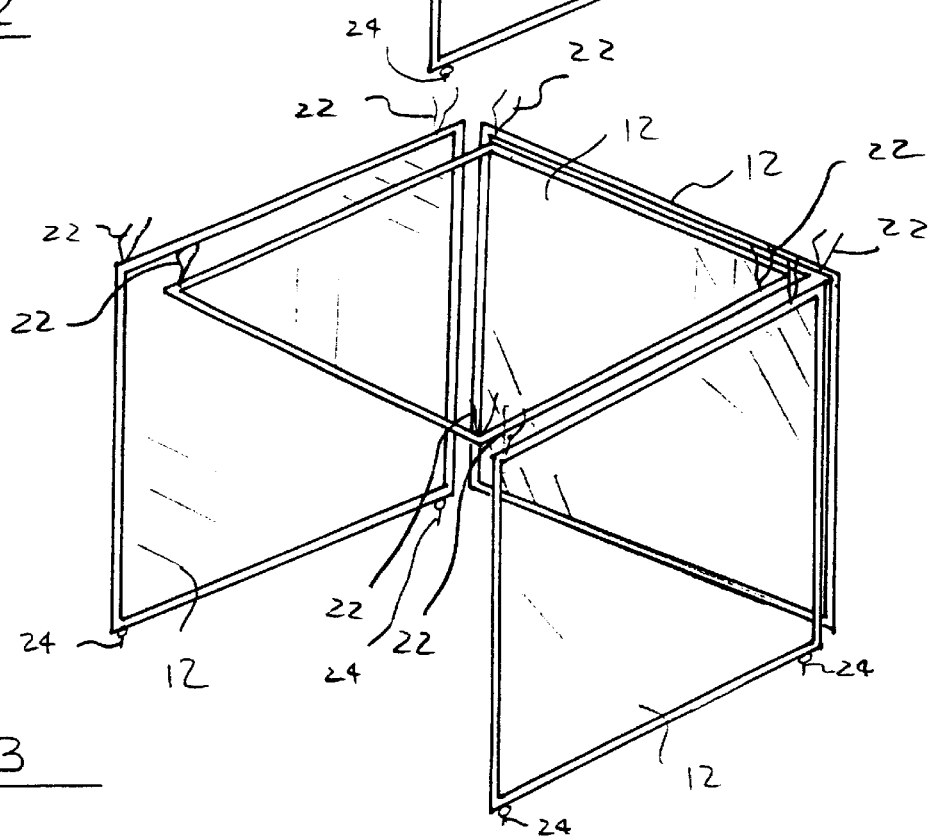
FIG. 3 is a perspective view of a second preferred embodiment of the netting panels of present invention.

The netting panels 12 are arranged so that, when attached to the tubular frame 10, the netting panels 12 preferably enclose the tubular frame 10, except for one side plane of the frame 10, as seen in FIG. 1, to form an opening 32. The netting panel 12 is preferably formed of a mesh-type netting fabric made from any natural or synthetic fiber, such as nylon. The mesh preferably has openings of about 0.25 inch. The netting panels 12 are advantageously and preferably joined about their edge peripheries to form an integral regular netting prism 20, such as shown in FIG. 2. However, the netting panels 12 can also be retained as separate panels to be individually attached to the frame 10, as shown in FIG. 3. This latter embodiment is preferred for a number of applications as discussed further below.

Preferably, attachment means 22 in the form of tying straps are provided at each upper corner of the netting prism 20, as seen in FIG. 2, or the individual netting panels 12, as seen in FIG. 3. These tying straps 22 are used to tie the netting prism 20 or netting panels 12 to the tubular frame 10, either to the intermediate tubular pole segments 14 or, preferably, to each of the upper corner units 16, as will be discussed below. It should be noted that several interchangeable means may be used to attach the upper corner of the netting prism 20 or netting panels 12 to the tubular frame 10, including hook and loop straps, hooks and snap arrangements. The exact attachment means 22 is not so important as that the attachment means 22 must be adapted for ready attachment and detachment of the upper corner of the netting prism 20 or netting panels 12 to the tubular frame 10, while also providing a relatively secure attachment that is resistant to accidental separation of the netting prism 20 or netting panels 12 from the tubular frame 10. Moreover, it is contemplated that intermediate attachment means 22, positioned between the upper corner units 16, can be provided to provide a more uniform support of the netting prism 20 or netting panel 12 along the intermediate tubular pole segments 14, as shown in FIG. 2.

Referring to FIG. 6, there is shown in detail a preferred lower attachment means 24 for attaching the bottom corners of the netting prism 20 or the netting panels 12 to the bottom of the intermediate segment 14 of the tubular frame 10. The lower attachment means 24 preferably includes an elastomeric retaining strap 26 fixedly attached to the lower corner of the netting prism 20 or netting panels 12, through which is securely held a retaining pin 28. The retaining pin 28 is adapted to be inserted into a lower open end of one of the intermediate tubular pole segments 14. After the upper portion of the netting prism 20 or the netting panel 12 is secured to the upper corner unit 16 or frame 10, such that the vertical extent of the netting prism 20 or netting panel 12 can be placed in tension, the retaining strap 26 is stretched so the retaining pin 28 can be inserted in the lower open pole. Once released, the tension in the netting prism 20 or netting panel 12 and retaining strap 26 retains the lower corner to the tubular frame 10.

Again, several interchangeable lower attachment means 24 may be used to attach the lower corner of the netting prism 20 or netting panels 12 to the bottom of the intermediate segment 14, including hook and loop straps, hooks and snap arrangements. The lower attachment means 24, however, must be adapted for ready attachment and detachment of the lower corner of the netting prism 20 or netting panels 12 to the intermediate tubular pole segment 14, while also providing a relatively secure attachment that resists accidental separation of the netting prism 20 or netting panels 12 from the tubular frame 10. Although not shown, tether lines can extend from the intermediate segments 14 or the upper corner units 16 to anchor the net assembly 1 via ground stakes at locations oblique to the plane of the net assembly 1, as is known. Alternatively, or in conjunction with tether lines, ground stakes can be inserted through the retaining pin 28 at ground level to secure the net assembly 1, but allow the net assembly 1 to be easily moved.

A first embodiment of the upper corner unit 16 is shown in FIG. 7. The corner units 16 comprise at least three projecting pole receiving portions 18, preferably extending orthogonally in two horizontal and one vertical depending directions, best seen in FIGS. 7, 9, 10 and 17. Each pole receiving portion 18 receives one end of one of the interchangeable intermediate pole segments 14, with the horizontally projecting pole receiving portions 18, interconnecting by the horizontal pole segments 14, preferably forming a flat horizontal top plane. The vertically depending projecting pole receiving portion 18 of the corner unit 16 receives one of the four vertically depending and interchangeable intermediate tubular pole segments 14. The corner unit 16 is preferably fabricated from 0.063 inch cold rolled steel tubing, welded at the intersections to form the orthogonal shape.

Each of the pole receiving portion 18 is also preferably provided with a locking turnbuckle 34 having a threaded shank 36 that is threadingly received within a cooperating nut 38 welded to the outer surface of the pole receiving portion 18. A hole, not shown, extends through the tubular pole receiving portion 18, such that, when the end of one of the interchangeable intermediate pole segments 14 is inserted into the pole receiving portion 18, the turnbuckle 34 can be rotated and tightened so as to push against one side of the intermediate pole segment 14 for a snug fit therein, thereby locking the intermediate pole segment 14 into position. In this preferred embodiment, the tying straps 22 of the netting prism 20 or netting panels 12 can be attached to the tubular frame 10 through the turnbuckles 34.

As noted above, in the preferred embodiment, each of the tubular pole segments 14 have the same size and length, regardless of whether used in the vertical or horizontal orientation. Thus, in the preferred embodiment, the assembly takes on the shape of a regular square prism, or cube, where each of the tubular pole segments 14 are interchangeable with all the others, dramatically simplifying assembly.

Figure 8:
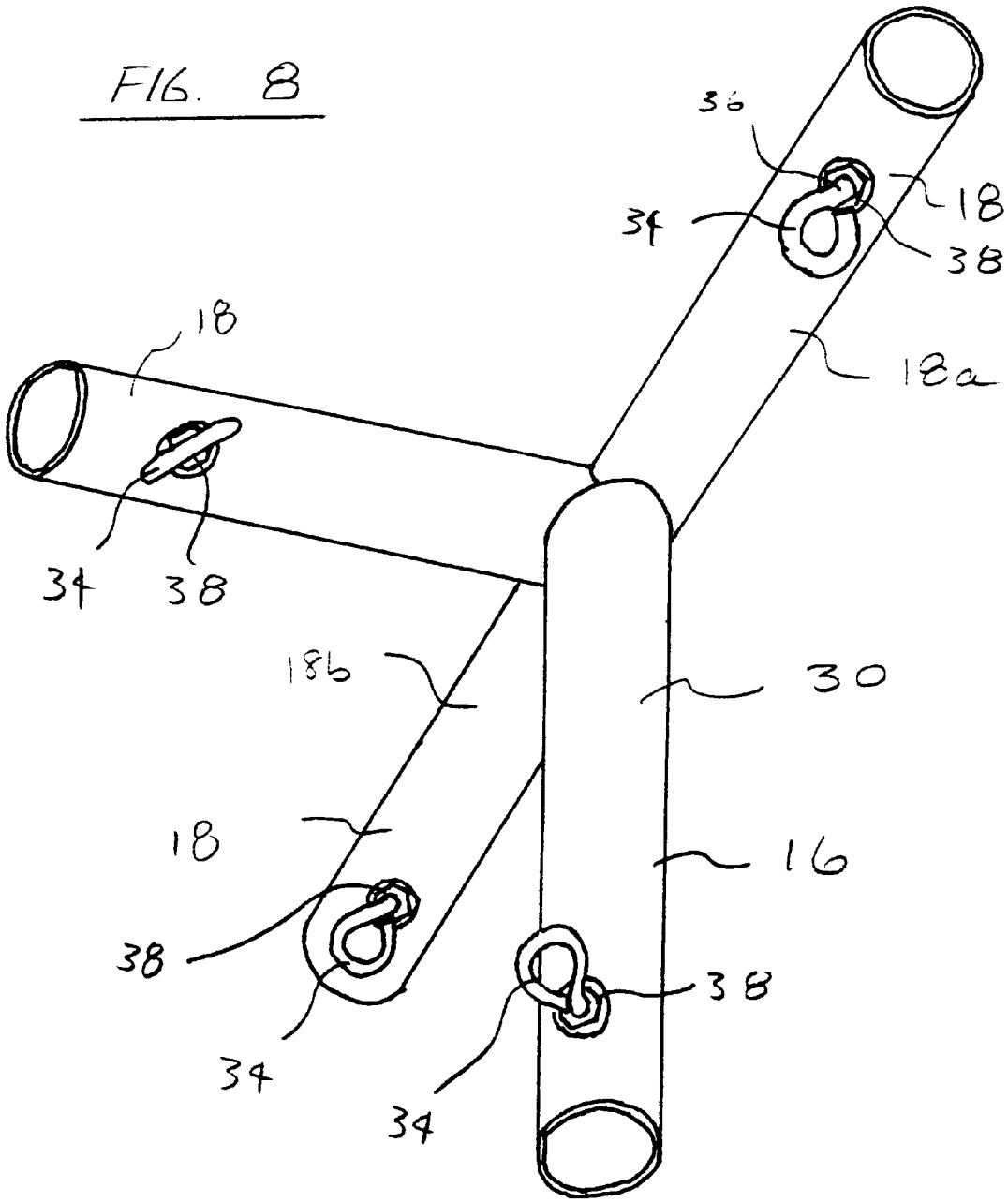
FIG. 8 is a perspective view of a second preferred embodiment of one of the corner units of the tubular frame of the present invention having orthogonally projecting pole receiving portions extending in the vertical and three horizontal directions, each of the pole receiving portions having locking turnbuckles.

A second embodiment of the upper corner unit 16 is shown in FIG. 8. There, the corner units 16 comprise three orthogonally projecting pole receiving portions 18 extending in two horizontal and one vertical depending directions, as before. However, a fourth pole receiving portion **18*b* extends in a horizontal direction opposite that of one of the two horizontally extending pole receiving portions 18*a*, as best seen in FIG. 8. This additional pole receiving portion 18*b* allows the corner unit to be transformed into an intermediate upper unit 30, which, as seen assembled in FIGS. 4 and 5, allows for elongated sport net assemblies by receiving an additional intermediate pole segments 14 in the additional horizontally projecting pole receiving portions 18*b***, to form an extended flat horizontal top plane.

Figure 4:
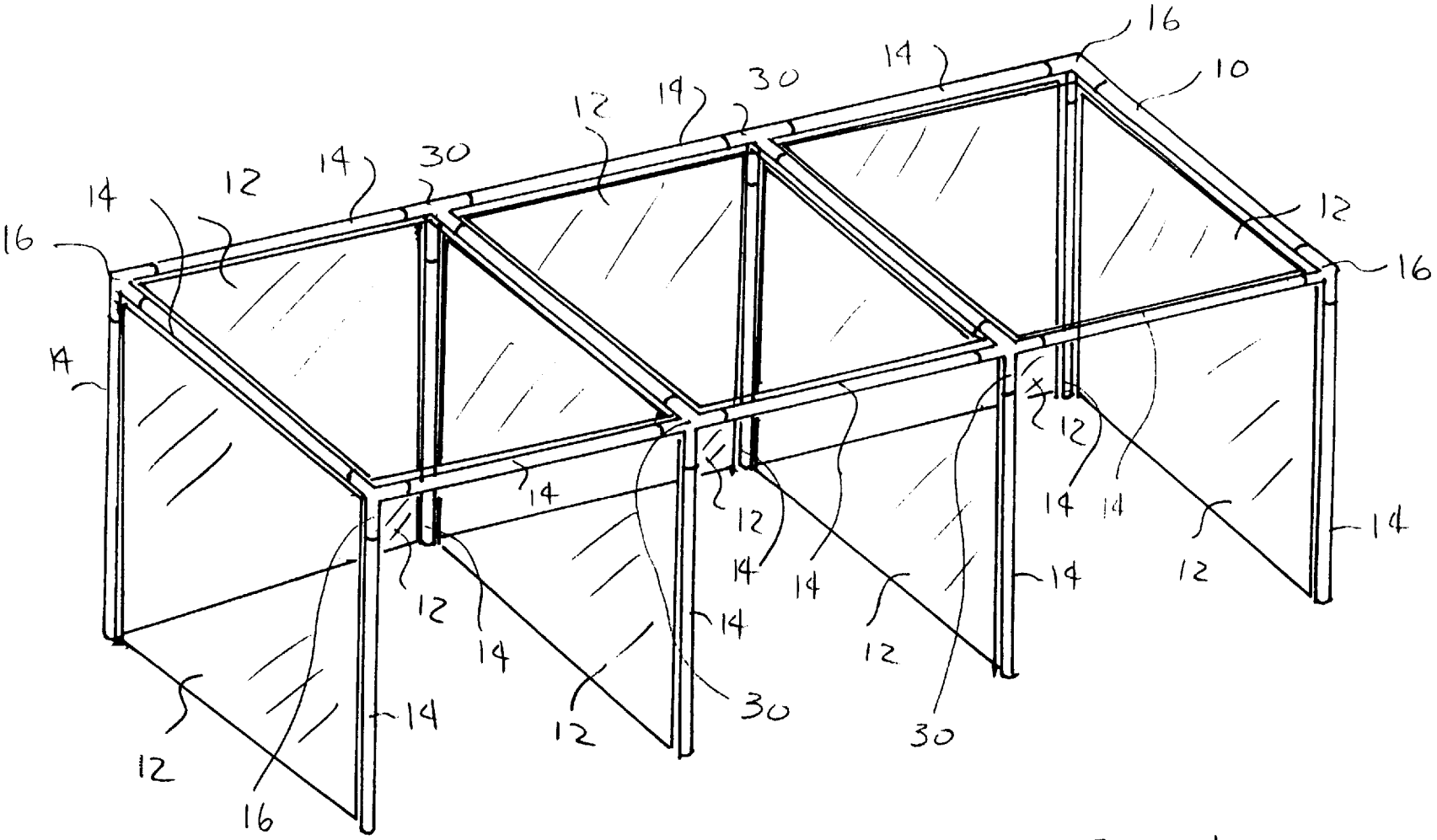
FIG. 4 is a perspective view of the all sports net of the present invention adapted to form a series of individual net cages, for example, as used in batting practice.

More particularly, shown in FIG. 4 is one of many possible adaptations of the sports net assembly of the present invention, wherein a series of openings are created along the longer length of essentially three cubic sports net assemblies 1 combined into a single assembly. The netting is formed from individual, discrete netting panels 12 attached to the tubular frame 10, forming an enclosure open on one side. Such a configuration would, for example, be especially useful in batting practice, where the players could line up in front of their respective cages or cubic net assemblies 1 created by the netting panels 12 and function substantially independently of, but simultaneously with, players standing in front of adjacent cubic net assemblies 1.

Figure 5:
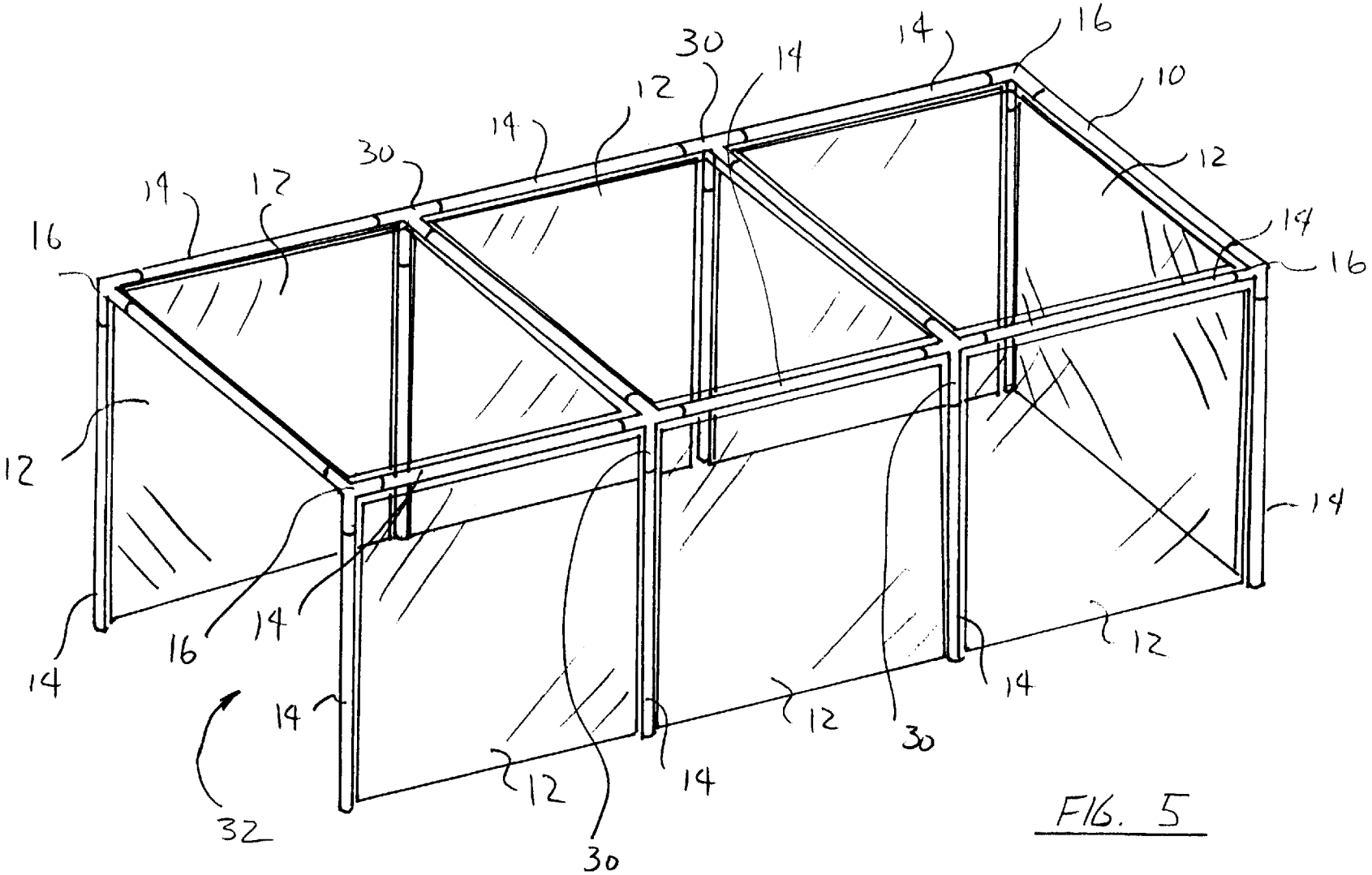
FIG. 5 is a perspective view of the all sports net of the present invention adapted to form a net tunnel, for example, as used in archery practice.

Alternatively, the netting panels 12, using exactly the same arrangement of tubular frames 10, could, with the exception of an end net assembly 1, be flexibly deployed to have two opposite sides open that, when combined with other net assemblies 1, can form extended nets or tunnels, as shown in FIG. 5. There, the only opening on the net assembly 1 is found at 32 and though which, for example, accuracy in throwing a football or in shooting at archery targets may be improved. It is further contemplated, for use with either netting panels 12 integrated into a netting prism 20 or as individual netting panels 12, that circular patterns or other indicia can be placed at the center of the netting panel 12 to serve as a target for accuracy practice.

Figure 9:
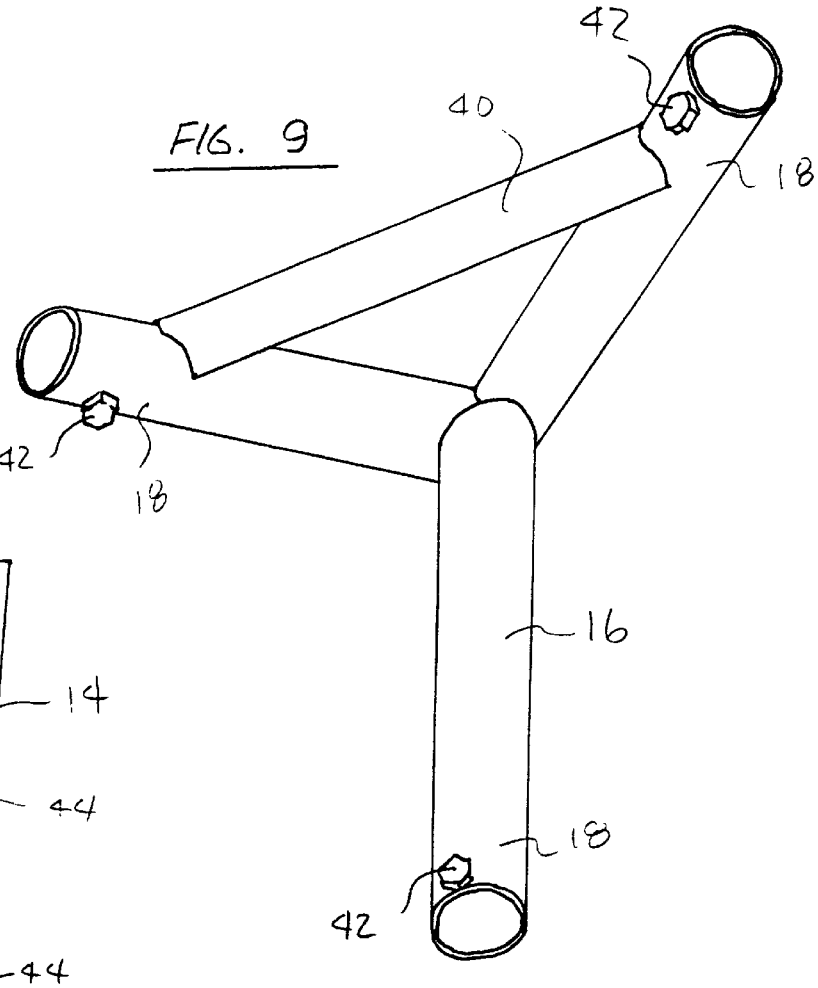
FIG. 9 is a perspective view of a third preferred embodiment of one of the corner units of the frame assembly of the present invention having orthogonally projecting pole receiving portions extending in the vertical and two horizontal directions, a bracing bar and locking members.

Two additional embodiments of the upper corner unit 16 are shown in FIGS. 9 and 10. The corner unit 16 of FIG. 9 is generally the same as that in FIG. 7 and broadly comprises three orthogonally projecting pole receiving portions 18 extending in two horizontal and one vertical depending directions. However, also provided is a crossmember bracing bar 40 welded to and extending between the horizontally extending pole receiving portions 18 for additional structural support and as an alternative location to which the tying straps 22 of the netting prism 20 or netting panels 12 can be attached to the tubular frame 10. Locking members 42, comprising a simple bolt-like fastener, are provided in place of the turnbuckles 34 and cooperating nut 38 welded to the outer surface of the pole receiving portion 18. Instead, the hole extending through the tubular pole receiving portion 18 is tapped for directly receiving the locking member 42, such that, when the end of one of the pole segment 14 is within the pole receiving portion 18, the locking member 42 is tightened to push against the intermediate pole segment 14 for a snug fit therein and locking the intermediate pole segment 14 into position.

The corner unit 16 of FIG. 10 is generally the same as that in FIG. 9, except that the locking members 42 are replaced with the turnbuckles 34 and cooperating nut 38. It should be noted that the turnbuckles 34 offer the additional advantage as to generally avoid the need for tools when assembling and disassembling the net assembly, in that they are more readily grasped and turned with the bare hand. However, it will be understood by those skilled in the art that retractable pin and corresponding opening attachment systems can be effectively applied to the pole receiving portions 18 of the present invention.

Figures 17, 18:
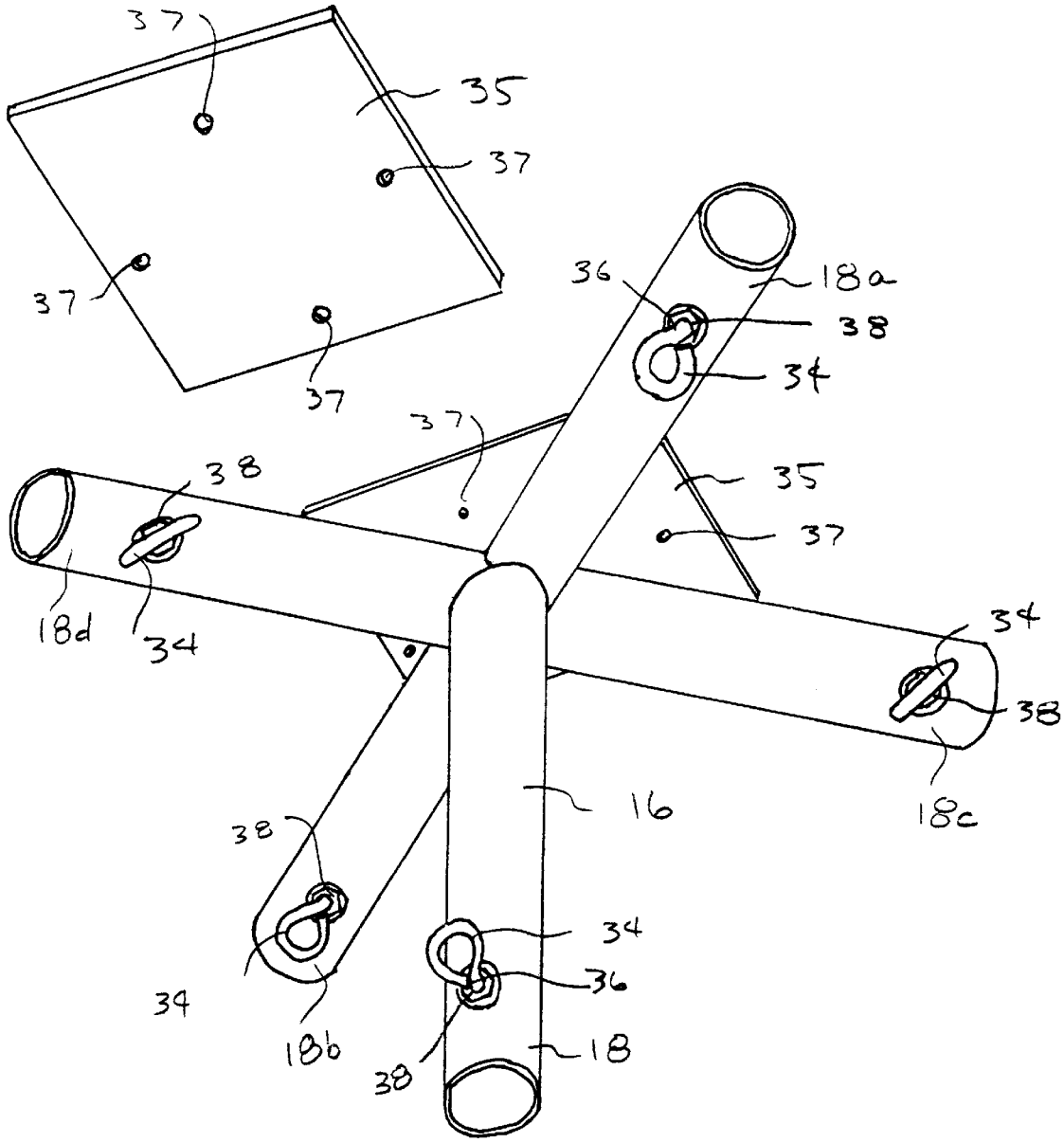
FIG. 17 is a perspective view of a fifth preferred embodiment of one of the corner units of the tubular frame of the present invention having orthogonally projecting pole receiving portions extending in the vertical and four horizontal directions, each of the pole receiving portions having locking turnbuckles, as well as a brace plate.
FIG. 18 is a perspective view of the brace plate for the corner unit of the tubular frame of the present invention.
Figure 19:
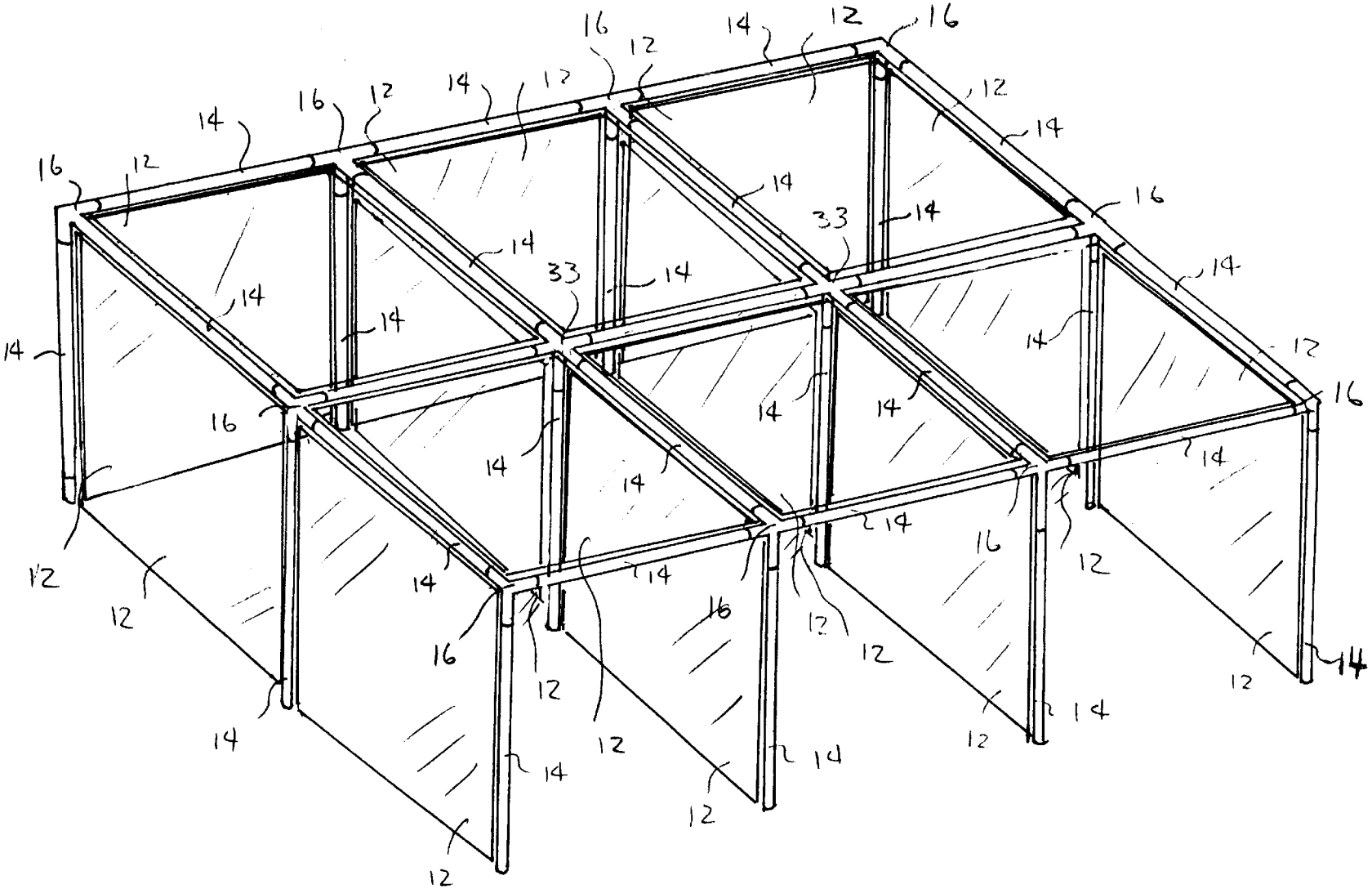
FIG. 19 is a perspective view of the modular all sports net of the present invention adapted to form a series of elongated individual net cages, for example, as used in archery practice.

Yet another embodiment of the upper corner unit 16 is shown in FIG. 17. There, the corner units 16 comprise the orthogonally projecting pole receiving portions 18 extending in two horizontal and one vertical depending directions, as well as fourth pole receiving portion 18*b* and fifth pole receiving portion 18*c* extending in horizontal directions opposite that of one of the original horizontally extending pole receiving portion 18*a* and 18*d*, respectively, as best seen in FIG. 17. These additional pole receiving portions 18*b* and 18*c* allow the corner unit to be transformed into an intermediate upper unit 33, which, as seen assembled in FIG. 19, allows for extended and elongated sport net assemblies by receiving an additional intermediate pole segment 14 in the additional horizontally projecting pole receiving portion 18 to form an extended and elongated flat horizontal top plane, for example, a series of cages for archery.

Preferably, the intermediate upper unit 33 includes a brace plate 35, best shown in FIG. 18, welded to the top of the horizontally extending pole receiving portions 18 for additional structural support, where openings 37 are provided to which the tying straps 22 of the netting prism 20 or netting panels 12 can be attached to the tubular frame 10.

Figure 20:
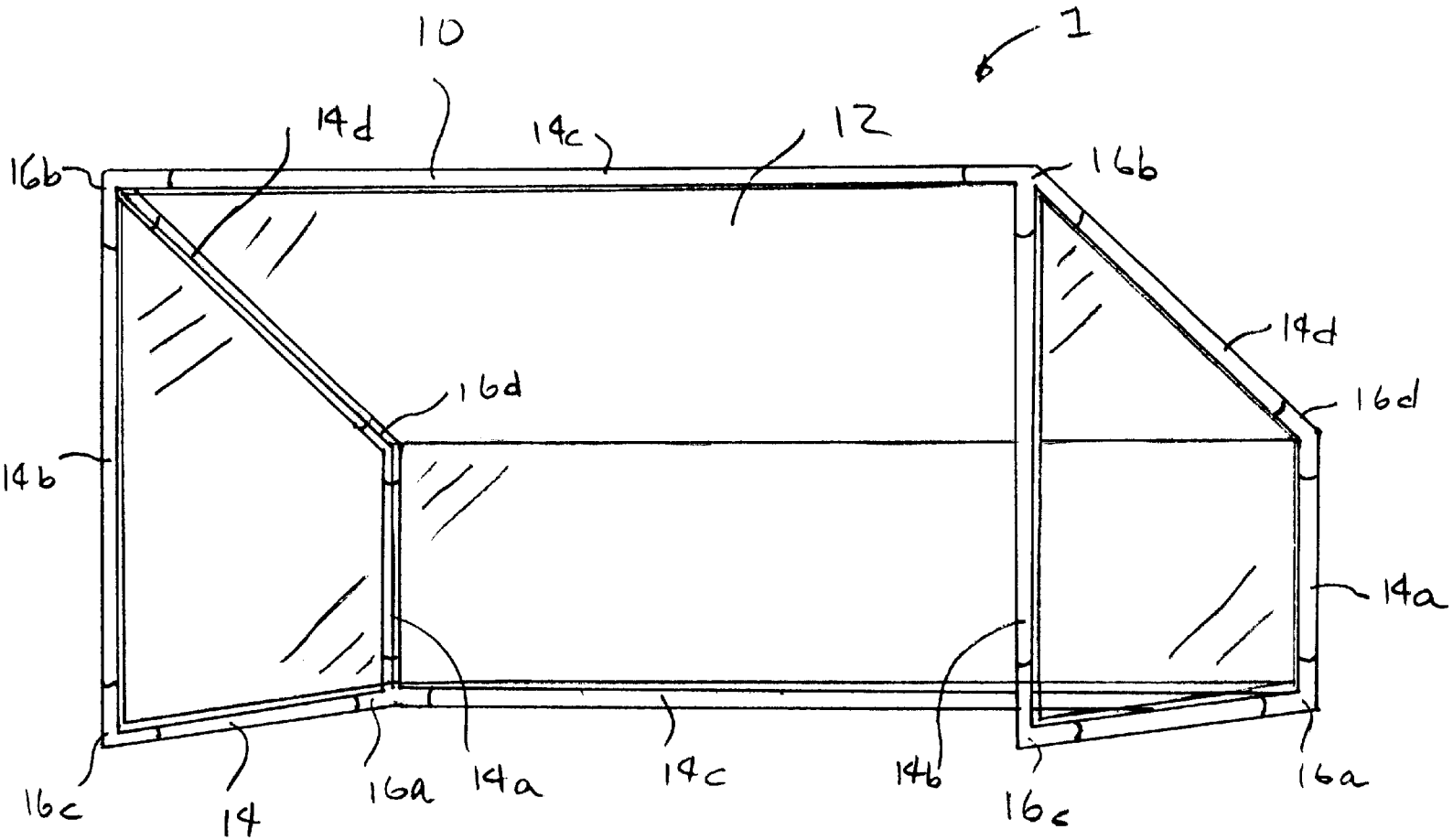
FIG. 20 is a perspective view of the modular all sports net of the present invention adapted to form non-rectangular prism, for example, as used in soccer.

A further adaptation of the sports net assembly of the present invention is shown in FIG. 20, wherein there is shown in perspective view another modular all sports net assembly 1 according to the present invention. The modular all sports net assembly 1 again consists primarily of a tubular frame 10 and a plurality of netting panels 12, but the tubular frame 10 of the present invention forms the shape of a irregular prism, preferably having trapazpoidally-shaped polygon ends, as seen in FIG. 20. In this embodiment, the tubular frame 10 includes two shorter vertical tubular pole segments 14*a* at the rear and two longer vertical tubular pole segments 14*b* at the front, with two identical horizontal tubular pole segments 14*c* interconnecting the two side ends. An additional two inclined tubular pole segments 14*d* interconnect the front and rear of the tubular frame 10. Each of the lower corner units 16*a* are similar to that applied to previous embodiments above, while a modified pair of upper corner units 16*b* are preferably provided with pole receiving portions 18 extending orthogonally in one horizontal and one vertical depending directions, as well as a downwardly inclined direction, as shown FIG. 20, of less than 90°. A pair of lower and upper elbow portions 16*c* and 16*d*, respectively, each also having a pair of pole receiving portions 18, complete the tubular frame 10. Each pole receiving portion 18 of the tubular frame 10 of FIG. 20 is adapted to receive one end of one of the intermediate pole segments 14 such that, when assembled, the modular all sports net assembly preferably adopts the form of a soccer net.

The netting 12 applicable to the modular all sports net assembly of the present invention is preferably formed from individual, discrete netting panels 12 attached to the tubular frame 10, forming an enclosure open on one side. Such a configuration would, for example, be especially useful in batting practice, where the players could line up in front of their respective cages or cubic net assemblies 1 created by the netting panels 12 and function substantially independently of, but simultaneously with, players standing in front of adjacent cubic net assemblies 1.

Figure 11:
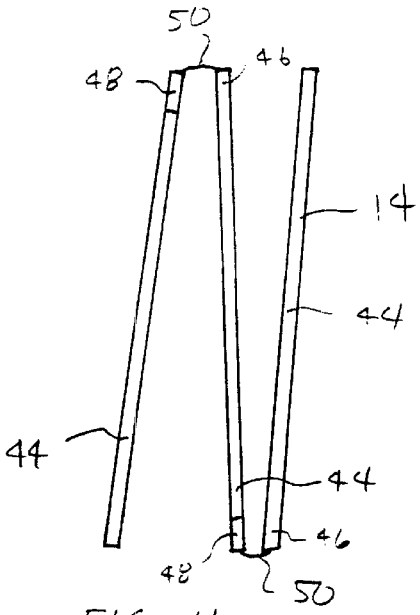
FIG. 11 is a plan view of one of the intermediate pole segments interconnecting the corner units in the folded condition.
Figure 12:
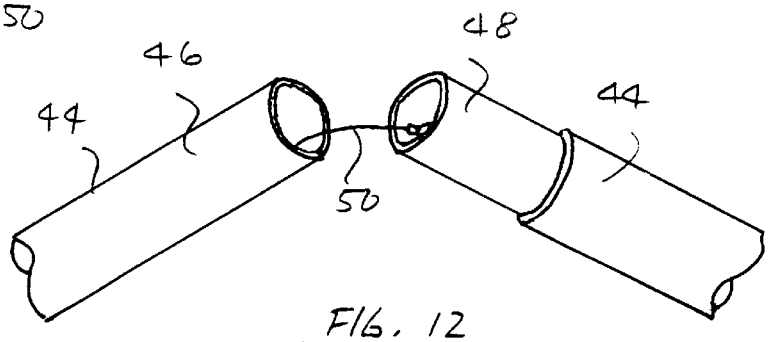
FIG. 12 is a close-up perspective view of one of the intermediate pole segments interconnecting the corner units showing the stretchable connecting cable visible in the folded condition.

An intermediate tubular pole segment 14 is shown in FIG. 11 and includes a plurality of (preferably three for the regular prism tubular frame 10) articulating and interlocking portions 44 having mating ends 46, 48, as shown in FIG. 12. Each of the pole segments 14 is also preferably fabricated from 0.063 inch cold rolled steel tubing and provided at a length of three meters. However, longer or shorter lengths can be used with smaller or larger nets to obtain the benefits of the present invention. The interior diameter of mating end 46 is larger than the exterior diameter of mating end 48 and receives end 48 therein to positively connect the portions 44. A stretchable connecting cable 50 connects each portion 44 of the intermediate pole segments 14 to maintain the portions 44 attached one to the other and to keep the portions 44 of the poles segments 14 readily available.

The stretchable connecting cable 50 is best seen in FIG. 13 and includes an elastomeric cord 52, also known as a shock cord, that is capable of stretching almost double its original length, attached to a braided stainless steel cable 54. A buckle 58 is attached at a first end 56 of the steel cable 54 by compression fit and a buckle 62 is similarly attached at a second end 60 of the steel cable 54. The elastomeric cord is looped through the buckle 58 and about itself to be fixedly and securely clamped via clamp 64 as shown, thereby forming loop 66 and becoming permanently attached to the steel cable 54. A looped wire segment 68 is secured through the loop 66 of the elastomeric cord 52 and an identical looped wire segment 70 is attached to the buckle 62 at the opposite end of the connecting cable 50.

Each of the wire segments 68, 70 are preferably provided with tangs 72, which as shown in FIG. 14, are inserted into one of the open mating ends 46 or 48 of the intermediate tubular pole segment 14 with the other in the opposite open mating end 48 or 46. The looped wire segment 68 must be pushed into the open mating end 46 or 48 a sufficient distance so that the elastomeric cord 52 is not exposed, leaving only the steel cable 54 to be seen. The looped wire segment 70 is similarly pushed into the opposite mating end 46 or 48, but is not inserted as far. However, each of the looped wire segments must be inserted sufficiently so that the elastomeric cord 52 must be stretched a bit to either assemble or disassemble the intermediate pole segments 14. The tangs 72, by virtue of the fact that they extend outwardly in excess of the interior diameter 74 of the mating ends 46, 48 when uncompressed, exert significant force against the interior diameter 74 of the portions 44 and thereby lock the connecting cable 50 firmly in position, regardless of the force exerted on the connecting cable 50 when stretched.

As can be seen in FIG. 12, the result is a connecting cable 50 where only the steel wire cable 54 is exposed. This is an improvement over the prior art shock cords, where rubbing against the open mating ends 46, 48 of the pole portions 44 has been found to cause abrading and undesirable failures. Moreover, the connecting cable 50, with only the steel cable exposed, is more resistant to cutting and failure from other sharp objects. Thus, as shown, the mating ends 46, 48 are readily available for manipulation and assembly/disassembly.

Figure 16:
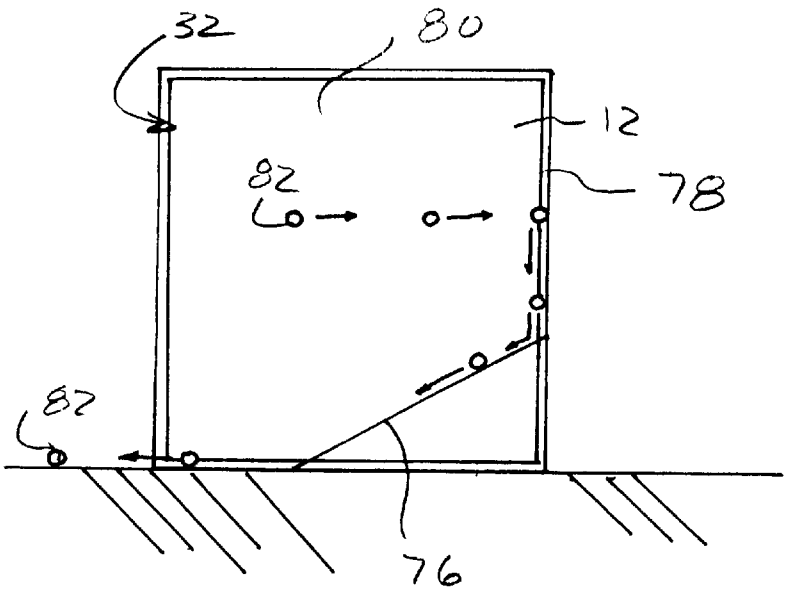
FIG. 16 is a cross-section view taken along the line 16—16 of FIG. 15 of the modular all sports net of the present invention adapted to include a ball return.
Figure 15:
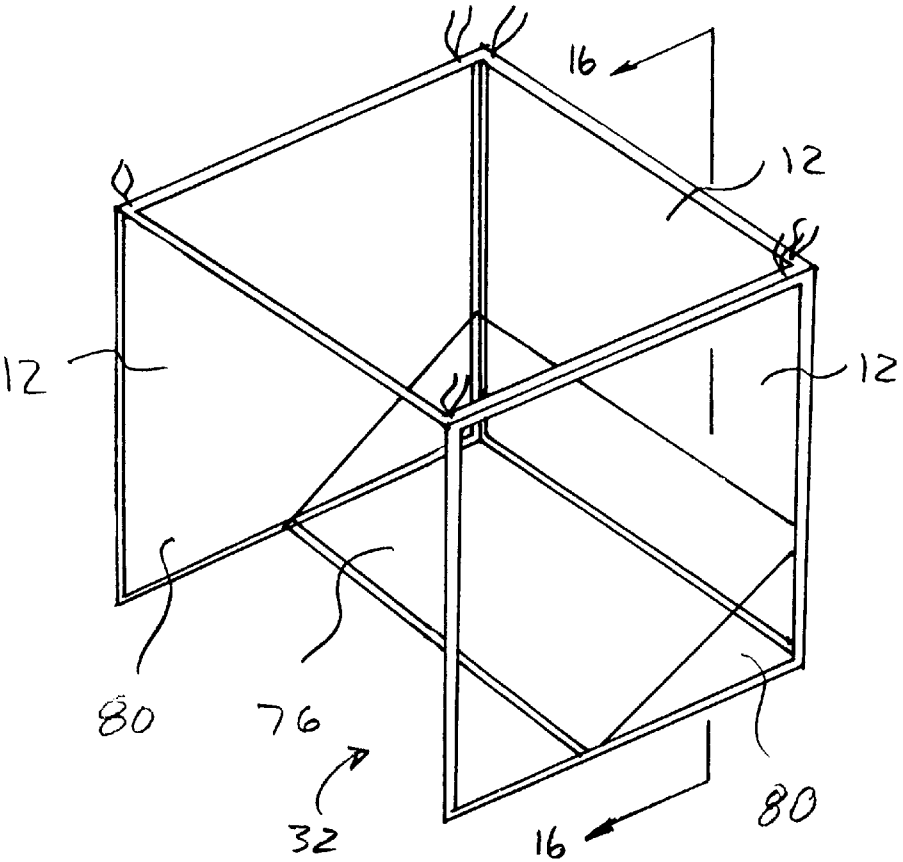
FIG. 15 is a perspective view of the modular all sports net of the present invention adapted to include a ball return.

As a further refinement to the instant invention, the netting panels can be provided with a detachable ball return feature, as seen in FIGS. 15 and 16. Preferably, this feature is added to the embodiment where the netting panels 12 are joined about their edge peripheries to form an integral regular netting prism 20, as is shown. However, this feature can also be used with individual netting panels 12 discussed above. The detachable ball return generally comprises an inclined panel 76, also preferably formed of a mesh-type netting fabric made from any natural or synthetic fiber, such as nylon, attached to a rear wall 78 and to each side walls 80 of the prism 20. The attachment means for attaching the inclined panel 76 to the netting prism 20 is preferably a detachable series of hooks that engage the mesh of the netting panels 12, allowing the net to be used for other purposes, such as soccer. However, if preferred, the inclined pane 76 can be sown into place.

As shown in FIG. 16, the ball return feature is obtained largely through the force of gravity. The ball 82 is shown in the air at it approaches the rear wall 78. When the ball 82 encounters the rear wall 78, its kinetic energy is dissipated and the ball 82 begins to fall toward the ground and inclined panel 76. Upon encountering the inclined panel 76, the ball 82 is redirected toward the opening 32 of the net assembly 1 and thus returned out of the net assembly 1.

The steps required to set up the preferred embodiment of the modular all sports net assembly 1 of the present invention are straightforward and easily accomplished by a single person. The portions 44 of the pole segments 14 are aligned one to the other and mating ends 48 are inserted into mating end 46, where the connecting cable 50 causes the portions 44 to form the assembled pole segment 14. This assembly is maintained in position through the residual tension remaining in the connecting cable 50. The ends of each of four horizontal pole segments 14 are inserted into each of the horizontal pole receiving portions 18 of the upper corner units 16 to form a horizontal plane, with the turnbuckle 34 or locking members 42 being used to lock the pole segments 14 into place. An end of each of the remaining four pole segments 14 is similarly inserted into and locked within each of the vertically depending receiving portions 18 of the upper corner units 16 to form the side vertical planes. Thus, the tubular frame 10 is easily and readily assembled. The netting panels 12 are then attached to the frame 10 in the desired configuration through the tying straps 22 and lower attachment means 24. Once assembled, tether lines can be attached to further anchor the net assembly 1. Disassembly is simply the reverse process.

The objects of the invention have thus been attained in an economical, practical, and facile manner. While preferred embodiments and example configurations have been shown and described, it is to be understood that various further modifications and additional configurations will be apparent to those skilled in the art. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

What is claimed is:

1. A modular sports net assembly of the type forming an enclosure and used for receiving and retaining a sports item such as a ball or the like, wherein said assembly is assembled for deployment as a prism of varying shapes and sizes on any relatively flat ground surface and disassembled for storage, the assembly comprising:

a tubular intermitting frame having the shape of a polyhedron having two polygon sides in parallel planes and two sides formed in the shape of parallelograms formed from a plurality of intermediate tubular pole segments, at least a portion of said intermediate tubular pole segments interconnecting a plurality of corner units to form a plurality of orthogonal edge peripheries, said corner units including projecting pole receiving portions extending along at least three independent axes, each pole receiving portion receiving an end of said at least portion of said intermediate pole segments, wherein the frame defines at least three interconnected planes;

a plurality of separate, discrete planar netting panels each removably attached to one of said edge peripheries of the frame so as to enclose the frame except for at least one side plane when the frame assembled is deployed on said relatively flat ground surface;

said netting panels further comprise upper attachment means at each upper corner of said netting panels for ready attachment and detachment of said upper corners of said netting panels to said edge peripheries of said tubular frame, said upper attachment means comprising a fastener that is threadingly received in the outer surface of a pole in said tubular interfitting frame;

wherein said at least a portion of said intermediate tubular pole segments interconnecting said plurality of corner units comprise a plurality of articulating and interlocking portions having cooperating first and second mating ends, where an interior diameter of said first mating end is larger than an exterior diameter of said second mating end and receives said second mating end therein to positively connect the portions, and wherein a stretchable connecting cable interconnects at least two of the articulating and interlocking portions of said at least a portion of said intermediate tubular pole segments, the stretchable connecting cable including a wire segment at each end thereof, the wire segments including tangs located within said at least two of the articulating and interlocking portions whereby the tangs press against an interior surface of said at least two of the articulating and interlocking portions to positively connect the stretchable connecting cable to said at least two of the articulating and interlocking portions and to positively connect said at least two of the articulating and interlocking portions together.

2. The modular sports net assembly of claim 1, wherein the shape of the frame is a cube.

3. The modular sports net assembly of claim 1, wherein the shape of the frame is an irregular prism and having a corner unit having a projecting pole receiving portion extending at an angle of less than 90° relative another of said pole receiving portions.

4. The modular sports net assembly of claim 1, wherein said corner units comprise orthogonally projecting pole receiving portions extending in four horizontal and one vertical depending directions, two of said horizontally extending receiving portions extending in directions opposite one from other and the other two of said horizontally extending receiving portions extending in directions opposite one from other, the corner units being capable of receiving four horizontal intermediate pole segments, whereby said corner is adapted to be used as an intermediate upper unit for forming an extended flat horizontal top plane.

5. The modular sports net assembly of claim 1, wherein said corner unit further comprises a bracing plate attached to and extending between at least a pair of said extending pole receiving portions for additional structural support and to which the plurality of netting panels may be removably attached to the frame.

6. In combination with a practice sports net having a plurality of separate, discrete, planar netting panels arranged in intersecting planes to form an enclosure having at least three interconnected sides for receiving and retaining a sports item such as a ball or the like when deployed on a relatively flat ground surface, a frame adaptable to form a prism of varying shapes and sizes from a plurality of intermediate tubular pole segments interconnecting a plurality of corner units, at least a portion of said corner units having projecting pole receiving portions extending along at least three independent axes, each pole receiving portion receiving an end of said intermediate pole segments to form a plurality of orthogonal edge peripheries, said netting panels each being removably attached to one of said edge peripheries of the frame;

said netting panels further comprise upper attachment means at each upper corner of said netting panels for ready attachment and detachment of said upper corners of said netting panels to said edge peripheries of said tubular frame, said upper attachment means comprising a fastener that is threadingly received in the outer surface of a pole in said tubular interfitting frame;

wherein at least a portion of said intermediate tubular pole segments interconnecting said plurality of corner units comprise a plurality of articulating and interlocking portions having cooperating first and second mating ends, where an interior diameter of said first mating end is larger than an exterior diameter of said second mating end and receives said second mating end therein to positively connect the portions, and wherein a stretchable connecting cable interconnects at least two of the articulating and interlocking portions of said at least a portion of said intermediate tubular pole segments, the stretchable connecting cable including a wire segment at each end thereof, the wire segments including tangs located within said at least two of the articulating and interlocking portions whereby the tangs press against an interior surface of said at least two of the articulating and interlocking portions to positively connect the stretchable connecting cable to said at least two of the articulating and interlocking portions and to positively connect said at least two of the articulating and interlocking portions together.

7. The combination of claim 6, wherein said corner units comprise three horizontally extending pole receiving sections, each orthogonal to the other, whereby two of said frames may be joined together.

8. The combination of claim 6, wherein said connecting cable comprises an elastomeric cord and a steel cable, said elastomeric cord being fixedly attached at a first end to a first end of said steel cable, a first looped wire segment secured to a second, opposite end of the elastomeric cord, and a second looped wire segment attached to a second, opposite end of the steel cable, wherein each of the second ends of said elastomeric cord and said steel cable are secured to one of the first or second mating ends of the intermediate tubular pole segment with the other of the second ends of said elastomeric cord and said steel cable secured to the opposite of said first or second mating end, said first and second looped wire segment positioned in the first and second mating ends so that the elastomeric cord is not exposed.

9. The combination of claim 6, wherein wherein said corner units comprise four orthogonally projecting pole receiving portions extending in four horizontal and one vertical depending directions, two of said horizontally extending receiving portions extending in directions opposite one from other and capable of receiving three horizontal intermediate pole segments and said remaining two of said horizontally extending receiving portions extending in directions opposite one from other and capable of receiving three horizontal intermediate pole segments, whereby said upper corner is adapted to an intermediate upper unit for forming an extended flat horizontal top plane.

10. The combination of claim 6, wherein said netting panels further comprise upper attachment means at each corner of the netting panels for ready attachment and detachment of said corners of said netting panels to said tubular frame, while also providing relatively secure attachment resistant to accidental separation of the netting panels from the tubular frame, and bottom attachment means for ready attachment and detachment of the bottom corners of the netting panels to the bottom of said vertical intermediate segment of the tubular frame, while also providing relatively secure attachment resistant to accidental separation of the netting panels from the tubular frame.

11. The combination of claim 9, further comprising intermediate upper attachment means positioned between the corner units to provide a more uniform support of the netting panels along the intermediate tubular pole segments.

12. A tubular frame adaptable to form prisms of varying shapes and sizes from a plurality of intermediate pole segments interconnecting a plurality of corner units in combination with separate netting panels to form a plurality of orthogonal edge peripheries and used for receiving and retaining a sports item such as a ball or the like, wherein said tubular frame is adapted for deployment on any relatively flat ground surface and disassembled for storage and wherein said corner units of said a tubular frame have projecting pole receiving portions extending along at least three independent axes, each pole receiving portion receiving an end of one of said intermediate pole segments, wherein the tubular frame defines at least four separate interconnected sides; a plurality of separate, discrete, planar netting panels each removably attached to the tubular frame forming said enclosure, said netting panels occluding at least three of the sides; and attaching means for attaching the netting panels to the tubular frame;

said attaching means comprising an upper attachment means at each upper corner of said netting panels for ready attachment and detachment of said upper corners of said netting panels to said edge peripheries of said tubular frame, said upper attachment means comprising a fastener that is threadingly received in the outer surface of a pole in said tubular intermitting frame;

wherein said at least a portion of said intermediate pole segments interconnecting said plurality of corner units comprise a plurality of articulating and interlocking portions having cooperating first and second mating ends, where an interior diameter of said first mating end is larger than an exterior diameter of said second mating end and receives said second mating end therein to positively connect the portions, and wherein a stretchable connecting cable interconnects at least two of the articulating and interlocking portions of said at least a portion of said intermediate pole segments, the stretchable connecting cable including a wire segment at each end thereof, the wire segments including tangs located within said at least two of the articulating and interlocking portions whereby the tares press against an interior surface of said at least two of the articulating and interlocking portions to positively connect the stretchable connecting cable to said at least two of the articulating and interlocking portions and to positively connect said at least two of the articulating and interlocking portions together.

13. A modular sports net assembly of the type forming an enclosure of varying shapes and sizes and used for receiving and retaining a sports item such as a ball or the like, wherein said assembly is assembled for deployment on any relatively flat ground surface and disassembled for storage, the assembly comprising:

a tubular interfitting frame having the shape of a prism formed from a plurality of intermediate tubular pole segments interconnecting a plurality of upper corner units, each of the upper corner units having orthogonally projecting pole receiving portions extending in at least the vertical and two horizontal directions each pole receiving portion receiving an end of said intermediate pole segments, wherein the frame defines a flat horizontal top plane and four flat vertical side planes and forms a plurality of orthogonal edge peripheries; and a plurality of separate, discrete, planar orthogonally oriented netting panels each removably attached to one of the edge peripheries of said frame so as to enclose the frame except for at least one side plane when the frame assembled is deployed on said relatively flat ground surface;

said netting panels further comprise upper attachment means at each upper corner of said netting panels for ready attachment and detachment of said upper corners of said netting panels to said edge peripheries of said tubular frame, said upper attachment means comprising a fastener that is threadingly received in the outer surface of a pole in said tubular interfitting frame;

wherein at least a portion of said intermediate tubular pole segments interconnecting said plurality of corner units comprise a plurality of articulating and interlocking portions having cooperating first and second mating ends, where an interior diameter of said first mating end is larger than an exterior diameter of said second mating end and receives said second mating end therein to positively connect the portions, and wherein a stretchable connecting cable interconnects at least two of the articulating and interlocking portions of said at least a portion of said intermediate tubular pole segments, the stretchable connecting cable including a wire segment at each end thereof, the wire segments including tangs located within said at least two of the articulating and interlocking portions whereby the tangs press against an interior surface of said at least two of the articulating and interlocking portions to positively connect the stretchable connecting cable to said at least two of the articulating and interlocking portions and to positively connect said at least two of the articulating and interlocking portions together.

14. The modular sports net assembly of claim 13, wherein the shape of the regular prism is a cube.

15. The modular sports net assembly of claim 13, wherein said connecting cable comprises an elastomeric cord and a steel cable, said elastomeric cord being fixedly attached at a first end to a first end of said steel cable, a first looped wire segment secured to a second, opposite end of the elastomeric cord, and a second looped wire segment attached to a second, opposite end of the steel cable, wherein each of the second ends of said elastomeric cord and said steel cable are secured to one of the first or second mating ends of the intermediate tubular pole segment with the other of the second ends of said elastomeric cord and said steel cable secured to the opposite of said first or second mating end, said first and second looped wire segment positioned in the first and second mating ends so that the elastomeric cord is not exposed.

16. The modular sports net assembly of claim 15, wherein said looped wire segments are pushed into said first and second mating ends such that said elastomeric cord must be stretched from an initial position to either assemble or disassemble the intermediate pole segments.

17. The modular sports net assembly of claim 13 wherein said orthogonally oriented netting panels enclosing the frame form a back wall, two side walls and an opening when the frame is deployed on said relatively flat ground surface, said net assembly further comprising an inclined panel attached to said rear wall and to each of said side walls wherein said sports item entering the net assembly, after contacting the rear wall, falls toward the inclined panel and is redirected toward the opening of the net assembly.

18. The modular sports net assembly of claim 13, wherein said corer units comprise orthogonally projecting pole receiving portions extending in three horizontal and one vertical depending directions, two of said horizontally extending receiving portions extending in directions opposite one from other, the corner units being capable of receiving three horizontal intermediate pole segments, whereby said upper corner is adapted to be used as an intermediate upper unit for forming an extended flat horizontal top plane.

19. The modular sports net assembly of claim 13, wherein said plurality of orthogonally oriented netting panels is attached to the frame by removable attachment means attached to said intermediate pole segments.

20. The modular sports net assembly of claim 13, wherein said plurality of orthogonally oriented netting panels is attached to the frame by removable attachment means attached to each of said corner units.

21. The modular sports net assembly of claim 13, wherein said corner unit further comprises a crossmember bracing bar attached to and extending between said horizontally extending pole receiving portions for additional structural support and to which the plurality of orthogonally oriented netting panels may be removably attached to the frame.

22. The modular sports net assembly of claim 13, wherein each of said pole receiving portions of said upper corner units is provided with locking members for locking said intermediate pole segment within said pole receiving portions.

23. The modular sports net assembly of 22, wherein said locking members for locking said intermediate pole segment within said pole receiving portions comprises a locking turnbuckle having a threaded shank threadingly received within a cooperating nut attached to the pole receiving portion and extending through the tubular pole receiving portion, wherein when the end of one of the interchangeable intermediate pole segments is inserted into the pole receiving portion, the turnbuckle pushes against said intermediate pole segment for a snug fit therein.

24. The modular sports net assembly of claim 22, wherein said locking members for locking said intermediate pole segment within said pole receiving portions comprises a tapped hole extending through the tubular pole receiving portion for receiving a locking member, such that, when the end of one of the pole segment is within the pole receiving portion, the locking member push against the intermediate pole segment when tightened.

25. The modular sports net assembly of claim 13, wherein the intermediate poles segments are the same length and form a regular square prism.

26. In combination with a practice sports net having a plurality of separate, discrete substantially rectangular orthogonally oriented planar netting panels to form an enclosure having a top, bottom and at least two side edges for receiving and retaining a sports item such as a ball or the like when deployed on a relatively flat ground surface, a frame adaptable to form a prism of varying sizes and shapes from a plurality of intermediate tubular pole segments interconnecting a plurality of upper corner units, each of the upper corner units having orthogonally projecting pole receiving portions extending in at least the vertical and two horizontal directions, each pole receiving portion receiving an end of said intermediate pole segments, wherein the frame defines a flat horizontal top plane and four flat vertical side planes and a plurality of orthoginal edge peripheries, each of said netting panels being removably attached to one of the orthogonal edge peripheries of the frame;

said netting panels further comprise upper attachment means at each upper corner of said netting panels for ready attachment and detachment of said upper corners of said netting panels to said frame, said upper attachment means comprising a fastener that is threadingly received in the outer surface of a pole in said tubular interfitting frame;

wherein at least a portion of said intermediate tubular pole segments interconnecting said plurality of corner units comprise a plurality of articulating and interlocking portions having cooperating first and second mating ends, where an interior diameter of said first mating end is larger than an exterior diameter of said second mating end and receives said second mating end therein to positively connect the portions, and wherein a stretchable connecting cable interconnects at least two of the articulating and interlocking portions of said at least a portion of said intermediate tubular pole segments, the stretchable connecting cable including a wire segment at each end thereof, the wire segments including tangs located within said at least two of the articulating and interlocking portions whereby the tangs press against an interior surface of said at least two of the articulating and interlocking portions to positively connect the stretchable connecting cable to said at least two of the articulating and interlocking portions and to positively connect said at least two of the articulating and interlocking portions together.

27. The combination of claim 26, wherein said upper corner units comprise three horizontally extending pole receiving sections, each orthogonal to the other, whereby two of said frames may be joined together.

28. The combination of claim 27, wherein said connecting cable comprises an elastomeric cord and a steel cable, said elastomeric cord being fixedly attached at a first end to a first end of said steel cable, a first looped wire segment secured to a second, opposite end of the elastomeric cord, and a second looped wire segment attached to a second, opposite end of the steel cable, wherein each of the second ends of said elastomeric cord and said steel cable are secured to one of the first or second mating ends of the intermediate tubular pole segment with the other of the second ends of said elastomeric cord and said steel cable secured to the opposite of said first or second mating end, said first and second looped wire segment positioned in the first and second mating ends so that the elastomeric cord is not exposed.

29. The combination of claim 26, wherein wherein said upper corner units comprise three orthogonally projecting pole receiving portions extending in three horizontal and one vertical depending directions, two of said horizontally extending receiving portions extending in directions opposite one from other and capable of receiving three horizontal intermediate pole segments, whereby said upper corner is adapted to an intermediate upper unit for forming an extended flat horizontal top plane.

30. The combination of claim 26, wherein said netting panels further comprise additional attachment means for ready attachment and detachment of said netting panels to said tubular frame, said additional attachment means comprising a fastener that is threadingly received in the outer surface of a pole in said tubular frame, while also providing relatively secure attachment resistant to accidental separation of the netting panels from the tubular frame.

31. The combination of claim 30, wherein said additional attachment means comprises a turn buckle having a threaded shank that is threadingly received within a cooperating nut welded to the outer surface of a pole in said tubular intermitting frame, wherein said turn buckle can be routed and tightened so as to push against the side of the intermediate pole segment.

32. The combination of claim 26, further comprising intermediate upper attachment means positioned between the upper corner units to provide a more uniform support of the netting panels along the intermediate tubular pole segments.

33. The combination of claim 30, wherein said bottom attachment means includes an elastomeric retaining strap fixedly attached to a lower corner of said netting panels through which is securely held a retaining pin, said retaining pin cooperating with the lower open end of one of said intermediate tubular pole segments, after the upper corner of said netting panel is attached to the frame such that the vertical extent of the netting prism may be placed in tension, whereby the retaining strap is stretched so the retaining pin can be inserted in or removed from the lower open pole and, once released, the tension in the netting panel and retaining strap retains the lower corner of the netting panel attached to the tubular frame.

34. The combination of claim 33, wherein ground stakes are inserted through the retaining pin at ground level to secure the combination to the ground.

35. The combination of claim 26, wherein said netting panels further comprise indicia displayed thereon to serve as a target for accuracy practice.

36. The combination of claim 35, wherein said indicia comprise concentric circles.

37. A modular all sports net comprising a tubular frame in the shape of a regular square prism formed from a plurality of intermediate horizontal pole segments interconnecting a plurality of corner units and a plurality of vertical pole segments in combination with an enclosure and used for receiving and retaining a sports item such as a ball or the like, wherein said net is adapted for deployment on any relatively flat ground surface and disassembled for storage and wherein each of the corner units of said a tubular frame has orthogonally projecting pole receiving portions extending in at least the vertical and two horizontal directions, each pole receiving portion extending in the horizontal direction receiving an end of one of said horizontal intermediate pole segments and each pole receiving portion extending in the vertical direction receiving an end of one of said vertical pole segments, wherein the tubular frame defines a flat horizontal top plane and four flat vertical side planes to form a plurality of orthogonal edge peripheries; a plurality of separate, discrete orthogonally oriented planar netting panels, each netting panel removably attached to one of the orthogonal edge peripheries of said frame assembly, said netting panels occluding the horizontal top plane and at least two of the side vertical planes; and attaching means for attaching the netting panels to the tubular frame;

said attaching means comprising an upper attachment means at each upper corner of said netting panels for ready attachment and detachment of said upper corners of said netting panels to said tubular frame;

wherein at least a portion of said pole segments interconnecting said plurality of corner units comprise a plurality of articulating and interlocking portions having cooperating first and second mating ends, where an interior diameter of said first mating end is larger than an exterior diameter of said second mating end and receives said second mating end therein to positively connect the portions, and wherein a stretchable connecting cable interconnects at least two of the articulating and interlocking portions of said at least a portion of said pole segments, the stretchable connecting cable including a wire segment at each end thereof, the wire segments including tangs located within said at least two of the articulating and interlocking portions whereby the tangs press against an interior surface of said at least two of the articulating and interlocking portions to positively connect the stretchable connecting cable to said at least two of the articulating and interlocking portions and to positively connect said at least two of the articulating and interlocking portions together.

38. A tubular frame in the shape of a regular square prism formed from a plurality of intermediate horizontal pole segments interconnecting a plurality of corner units and a plurality of vertical pole segments in combination with an enclosure and used for receiving and retaining a sports item such as a ball or the like, wherein said tubular frame is adapted for deployment on any relatively flat ground surface and disassembled for storage and wherein each of the corner units of said a tubular frame has orthogonally projecting pole receiving portions extending, in at least the vertical and two horizontal directions, each pole receiving portion extending in the horizontal direction receiving an end of one of said horizontal intermediate pole segments and each pole receiving portion extending in the vertical direction receiving an end of one of said vertical pole segments, wherein the tubular frame defines a flat horizontal top plane and four flat vertical side planes to form a plurality of orthoginal edge peripheries; a plurality of separate, discrete, orthogonally oriented planar netting panels removably attached to one of said orthogonal edge peripheries of said enclosure, said netting panels occluding the horizontal top plane and at least two of the side vertical planes; and attaching means for attaching the netting panels to the tubular frame;

said netting panels further comprise upper attachment means at each upper corner of said netting panels for ready attachment and detachment of said upper corners of said netting panels to said tubular frame;

wherein at least a portion of said pole segments interconnecting said plurality of corner units comprise a plurality of articulating and interlocking portions having cooperating first and second mating ends, where an interior diameter of said first mating end is larger than an exterior diameter of said second mating end and receives said second mating end therein to positively connect the portions, and wherein a stretchable connecting cable interconnects at least two of the articulating and interlocking portions of said at least a portion of said pole segments, the stretchable connecting cable including a wire segment at each end thereof, the wire segments including tangs located within said at least two of the articulating and interlocking portions whereby the tangs press against an interior surface of said at least two of the articulating and interlocking portions to positively connect the stretchable connecting cable to said at least two of the articulating and interlocking portions and to positively connect said at least two of the articulating and interlocking portions together.

39. The modular sports net assembly of claim 1, wherein said upper attachment means comprises a turn buckle having a threaded shank that is threadingly received within a cooperating nut welded to the outer surface of a pole in said tubular interfitting frame, wherein said turn buckle can be rotated and tightened so as to push against one side of an intermediate pole segment.

40. The modular sports net assembly of claim 6, wherein said upper attachment means comprises a turn buckle having a threaded shank that is threadingly received within a cooperating nut welded to the outer surface of a pole in said tubular intermitting frame, wherein said turn buckle can be rotated and tightened so as to push against one side of an intermediate pole segment.

41. The modular sports net assembly of claim 12, wherein said upper attachment means comprises a turn buckle having a threaded shank that is threadingly received within a cooperating nut welded to the outer surface of a pole in said tubular interfitting frame, wherein said turn buckle can be rotated and tightened so as to push against one side of an intermediate tubular pole segment.

42. The modular sports net assembly of claim 13, wherein said upper attachment means comprises a turn buckle having a threaded shank that is threadingly received within a cooperating nut welded to the outer surface of a pole in said tubular interfitting frame, wherein said turn buckle can be rotated and tightened so as to push against one side of an intermediate tubular pole segment.

43. The modular sports net assembly of claim 26, wherein said upper attachment means comprises a turn buckle having a threaded shank that is threadingly received within a cooperating nut welded to the outer surface of a pole in said tubular interfitting frame, wherein said turn buckle can be rotated and tightened so as to push against one-side of an intermediate tubular pole segment.

44. The modular sports net assembly of claim 37, wherein said upper attachment means comprises a turn buckle having a threaded shank that is threadingly received within a cooperating nut welded to the outer surface of a pole in said tubular interfitting frame, wherein said turn buckle can be rotated and tightened so as to push against one side of an intermediate pole segment.

45. The modular sports net assembly of claim 38, wherein said upper attachment means comprises a turn buckle having a threaded shank that is threadingly received within a cooperating nut welded to the outer surface of a pole in said tubular interfitting frame, wherein said turn buckle can be rotated and tightened so as to push against one side of an intermediate pole segment.

* * * * *

UNITED STATES PATENT AND TRADEMARK OFFICE

CERTIFICATE OF CORRECTION

PATENT NO. : 6,579,196 B1
DATED : June 17, 2003
INVENTOR(S) : Young W. Yoon

It is certified that error appears in the above-identified patent and that said Letters Patent is hereby corrected as shown below:

Title page,
Item [57], ABSTRACT,
Line 10, “axis” should be -- axes --;

Column 1,
Line 18, “an” should be -- a --;
Line 39, delete “a” before “positioned”;
Line 55, after “storage” insert -- . --;

Column 2,
Line 3, before “number” insert -- a --;

Column 3,
Line 40, before “present” insert -- the --;

Column 4,
Line 19, “cross-section” should be -- cross-sectional --;

Column 6,
Line 63, delete “an”;

Column 7,
Line 18, “though” should be -- through --;

Column 8,
Line 20, “trapazpoidally-shaped” should be -- trapezoidally-shaped --;
Line 33, after “shown” insert -- in --;

Column 12,
Line 40, delete second occurrence of “wherein”;
Lines 45 and 48, before “other” insert -- the --;

Column 13,
Line 24, “intermitting” should be -- interfitting --;
Line 39, “tares” should be -- tangs --;

Column 14,
Line 61, “corer” should be -- corner --;
Line 65, before “other” insert -- the --;

UNITED STATES PATENT AND TRADEMARK OFFICE

CERTIFICATE OF CORRECTION

PATENT NO. : 6,579,196 B1
DATED : June 17, 2003
INVENTOR(S) : Young W. Yoon

It is certified that error appears in the above-identified patent and that said Letters Patent is hereby corrected as shown below:

Column 15,
Line 21, before "22" insert -- claim --;
Line 36, "segment" should be -- segments --;
Line 37, "member" should be -- members --;
Line 40, "poles" should be -- pole --;
Line 56, "orthoginal" should be -- orthogonal --;

Column 16,
Line 37, delete second occurrence of "wherein";
Line 42, before "other" insert -- the --;

Column 17,
Line 27, delete "a" before "tubular";

Column 18,
Line 9, delete "a" before "tubular";
Line 17, "orthoginal" should be -- orthogonal --;
Line 60, "intermitting" should be -- interfitting --; and Column 19,
Line 15, "one-side" should be -- one side --.

Signed and Sealed this

Fifteenth Day of June, 2004

JON W. DUDAS
*Acting Director of the United States Patent and Trademark Office*